US005924718A

United States Patent [19]

Gordon et al.

[11] Patent Number: 5,924,718

[45] Date of Patent: Jul. 20, 1999

[54] SNOWBOARD AND METHOD FOR MAKING SAME

[76] Inventors: Robert H. Gordon, 12038 Devilwood Dr.; Jack E. Spector, 9612 Windcroft Way, both of Potomac, Md. 20854; Mario Serrano, 89 Old Meadow Plain Rd., Weatogue, Conn. 06089

[21] Appl. No.: 08/704,444

[22] Filed: Aug. 27, 1996

[51] Int. Cl.[6] ..... A63C 5/00

[52] U.S. Cl. ..... 280/610; 280/14.2

[58] Field of Search ..... 280/610, 609, 280/14.2, 602

[56] References Cited

U.S. PATENT DOCUMENTS

| | | | |
|---|---|---|---|
| 3,894,745 | 7/1975 | Heim et al. | 280/610 |
| 4,667,977 | 5/1987 | LaCroix | 280/610 |
| 5,673,926 | 10/1997 | Gauer | 280/610 |

*Primary Examiner*—Richard M. Camby
*Attorney, Agent, or Firm*—Venable, Baetjer, Howard & Civiletti, LLP

[57] ABSTRACT

A recreational board which adapted to be ridden by a user has a thermoplastic upper portion with an outer surface and an inner surface, a thermoplastic lower portion including a plurality of flanges, is bonded together by joining the plurality of flanges to the inner surface of the upper portion.

5 Claims, 3 Drawing Sheets

SNOWBOARD AND METHOD FOR MAKING SAME

BACKGROUND OF THE INVENTION

1. Field of the Invention

The present invention relates generally to winter sports equipment known as snowboards, and more particularly to an improved snowboard and methods for making same.

2. Statement of the Prior Art

Snowboarding is fast becoming one of the most popular winter sports for today's youth. According to Ski Industries America (SIA), a national, nonprofit, member-owned trade association representing more than one thousand snowboard, skiing, and on-snow product manufacturers, distributors, and suppliers, the average age of riders responding to the 1995 SIA Snowboard Survey is 22. Most riders (38%) are in the 12–17 age group, but 36% are ages 18–24 and 18% are ages 25–34. Men outnumber women by a three-to-one margin. In Nagano, Japan, at the 1998 Winter Olympics, snowboarding will become an Olympic medal sport.

Nearly 80% of the respondents to that survey have their own snowboard. Of such respondents, 58% own one snowboard, 30% have two snowboards, 6% own three snowboards, and 6% have four or more snowboards. Snowboards, like snowboarders, come in a variety of sizes and shapes. Most popular are the so-called "freeriding" and "freestyle" type snowboards, which are used by nearly ninety percent of all snowboarders. According to the SIA, freeriding boards are designed to perform on a variety of terrain under varying conditions, from bumps to groomed steeps to knee-deep powder in the trees. Freeriding boards are usually directional, meaning they have a distinct nose and tail. While they can also be ridden backwards, optimal performance comes with the nose pointed downhill. Freestyle boards, on the other hand, have twin tips—the nose and tail are shaped equally, for riding forwards and backwards. These boards are favored for riding in halfpipes and snowboard parks, where riders perform skateboard-like tricks. Freeriding boards are generally longer—in excess of 180 centimeters, while freestyle boards run between 140 to 160 centimeters. Nearly all freeriding and freestyle boards are used with soft boots.

Ten percent of the survey's respondents had no idea what kind of snowboard they used, but 2% admitted using a racing type of snowboard, commonly referred to as an alpine or carving snowboard. Such snowboards are designed for long, arcing turns on groomed slopes. Alpine snowboards are fully directional, with a flat tail, and meant to be ridden only forward. Unlike freeriding and freestyle snowboards, which are usually ridden with soft boots, riders on alpine snowboards utilize plate bindings and hard plastic boots similar to ski boots. Alpine snowboards are popular with many crossover skiers because of the similar boots and the ski-type turns. A snowboarder's stance with hard boots is forward and aggressive—like skiing, as opposed to the more relaxed surf or skate-type stance used with soft boots.

Wood core "cap" construction, a technique which wraps a wooden core in fiberglass and covers the top and sides with a one-piece cap for snappy response, is widespread in the snowboard industry. Certain other designs (e.g., Morrow's 3D Revert freestyle snowboard) have rods which impart progressive flexibility and strength to the snowboard, while others (e.g., Killer Loop's freestyle Trick snowboards) use a modified "fiber tube" cap construction to provide for lighter weight and increased control. Traditionally, however, a laminated wood core construction with no cap has been used.

Women's and children's snowboards are typically "softer" and shorter. For example, since the transference of a snowboarder's weight from heel-side to toe-side is a fundamental element of turning a snowboard, it is vitally important to provide snowboards with a greater propensity for flexibility to enable the generally smaller-sized women and children to control turning of their snowboards.

One significant problem with most snowboards today is "creep". Creep is the property of a material to deform under constant load, and snowboards of the prior art experience such creep in use and in storage. Creep causes a snowboard to lose its camber, a characteristic which would not only affect the performance of the snowboard (e.g., its ability to perform skateboard-like tricks in halfpipes and snowboard parks), but also likely ruin it entirely.

SUMMARY OF THE INVENTION

Accordingly, it is a general object of the present invention to provide a snowboard and improved methods for making same.

It is a more particular object of the present invention to provide a lightweight, highly maneuverable snowboard which is adaptable for use by all sizes of snowboarders.

Another more particular object of the present invention is to provide an improved snowboard and methods for making same which avoid the problems of creep.

These and other objects, advantages, and novel features according to the present invention are provided by a snowboard comprising a thermoplastic upper portion having an outer surface and an inner surface, a thermoplastic lower portion including a plurality of flanges, and means for bonding said plurality of flanges to said inner surface of said upper portion.

The snowboard according to a presently preferred embodiment of this invention forms the upper and lower portions of a thermoplastic selected from the group consisting of acrylonitrile-butadiene-styrene (ABS), acetates, acrylics, cellulosics, chlorinated polyethers; fluorocarbons, polyamides, polycarbonates, polyethylenes, polypropylenes, polyimides, polyphenylene oxides, polystyrenes, polysulfones, polyurethanes, polyvinyl chlorides, and alloys thereof. Even more preferably, the selected thermoplastic comprises a polycarbonate.

According to one important aspect of the present invention, the upper and lower portions of the snowboard each comprise a sheet of the selected thermoplastic which is thermoformed to a respectively selected shape. Alternatively, the upper and lower portions each comprise said selected thermoplastic formed to the respectively selected shape by injection molding.

The upper portion conveniently includes a peripheral rim which is formed between the outer and inner surfaces, and the plurality of flanges preferably comprises a peripheral collar and a plurality of ribs. In such a manner, the bonding means bonds the peripheral rim to the peripheral collar and the plurality of ribs to the inner surface of the upper portion. Therefore, the peripheral rim and the peripheral flange define a substantially similar peripheral shape. In accordance with another important aspect of the present invention, the bonding means comprises plastic welding or bonding by such other suitable means as a thermosetting resin. Preferably, the thermosetting resin comprises an epoxy resin.

The present invention is also directed to a method of making a snowboard which generally comprises the steps of forming a first thermoplastic portion having an outer surface and an inner surface, forming a second thermoplastic portion, and bonding the second portion to the inner surface of the first portion. As in the snowboard according to the present invention, such method further comprises the step of selecting a thermoplastic for the first and second portions from the group consisting of acrylonitrile-butadiene-styrene (ABS), acetates, acrylics, cellulosics, chlorinated polyethers; fluorocarbons, polyamides, polycarbonates, polyethylenes, polypropylenes, polyimides, polyphenylene oxides, polystyrenes, polysulfones, polyurethanes, polyvinyl chlorides, and alloys thereof. Even more preferably, the selected thermoplastic comprises a polycarbonate.

The first forming step (i.e., that of forming the first portion) suitably comprises the steps of providing a sheet of a selected thermoplastic, and thermoforming the sheet to a shape selected for said first portion. In a similar manner, the second forming step (i.e., that of forming the second portion) comprises the steps of providing a sheet of a selected thermoplastic, and thermoforming the sheet to a shape selected for the second portion.

Alternatively, the first forming step comprises the steps of providing an injection mold with a cavity corresponding to a shape selected for the first portion, injecting a selected thermoplastic into the mold, and withdrawing the molded first portion from said mold. In a similar manner, the second forming step comprises the steps of providing an injection mold with a cavity corresponding to a shape selected for the second portion, injecting a selected thermoplastic into said mold, and withdrawing the molded second portion from the mold.

Methods of forming a snowboard according to the present invention may further comprise the steps of forming a peripheral rim between the outer and inner surfaces, and forming a plurality of flanges in the second portion, each such flange providing a corresponding bonding site for the first and second portions.

The bonding step, in accordance with one preferred embodiment of the present invention comprises the step of welding the second portion to the first portion at each such bonding site. Alternatively and according to another preferred embodiment of the present invention, the bonding step comprises the step of applying a thermosetting resin between the first and second portions. One suitable such thermosetting resin is an epoxy resin.

In accordance with yet another important aspect of the present invention, the snowboard is fitted with one or more springs to provide responsive flexibility while at the same time preserving selected camber of the snowboard so formed. A pair of leaf springs, held in position between respective cavities formed between the upper and lower portions of the snowboard, provide such flexibility and camber-preservation means according to a presently preferred embodiment of this invention.

Further aspects, details and features of a presently preferred embodiment of this invention will become readily apparent from the following detailed description thereof, when considered in conjunction with the accompanying drawings wherein:

DETAILED DESCRIPTION OF A PREFERRED EMBODIMENT

Figure 1:
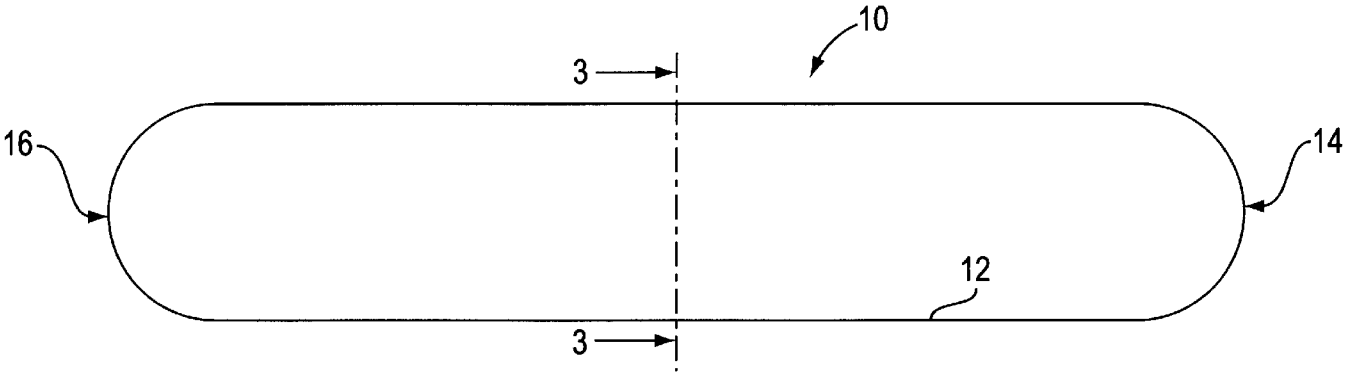
FIG. 1 is a plan view of an upper portion of the snowboard according to the present invention.

Referring now to the drawings, wherein like characters designate like or corresponding parts throughout the several views, there is shown in FIG. 1 a plan view of an upper or first portion 12 of the snowboard 10 according to the present invention. While it is apparent from both FIGS. 1 and 2 that snowboard 10 as shown is a freestyle snowboard, since its nose 14 and tail 16 are shaped substantially similarly, it should be noted that the construction of snowboard 10 according to the present invention is equally applicable to snowboards of the freeriding and alpine styles as well.

Figure 2:
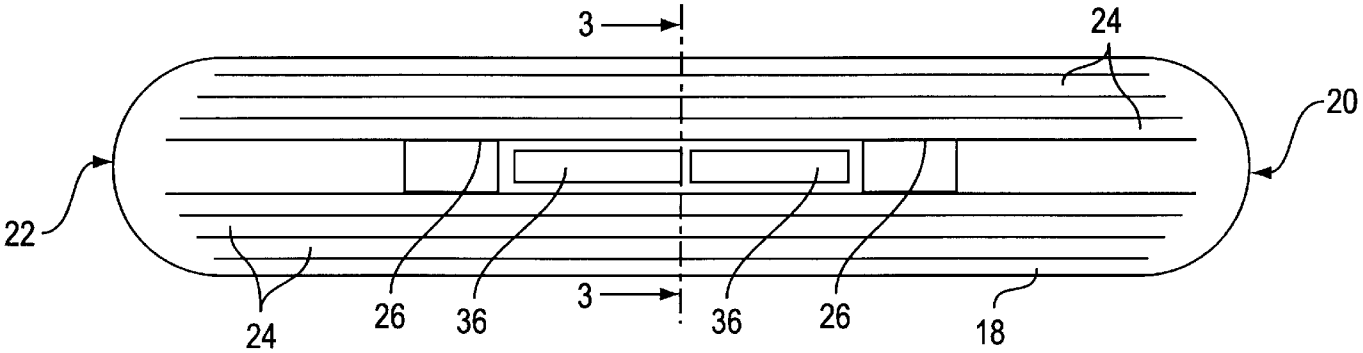
FIG. 2 is a plan view of a lower portion of the snowboard according to the present invention.

FIG. 2 shows a plan view of the lower or second portion 18 of the snowboard 10 according to the present invention. As is the case for the upper or first portion 12 of snowboard 10, the lower or second portion 18 includes a nose 20 and tail 22 which are shaped substantially similarly to the nose 14 and tail 16 of the upper or first portion 12. Snowboards of the freeriding and alpine styles can be likewise be made in accordance with the present invention insofar that their respective upper or first 12 and lower or second 18 portions are shaped substantially alike. Lower or second portion 18 also includes a plurality of ribs 24 which provide a selectable degree of stiffness to the snowboard 10. The particular number, size and configuration (i.e., shape, thickness, etc.) of such ribs 24 will be dependent upon the degree of stiffness desired. A pair of pockets 26 are also formed in the lower or second portion 18 for insertion of conventional inserts (not shown) which are used to attach the snowboard's bindings. One or more leaf springs 36 (FIG. 2) may be added between the pockets 26 to provide selectable flexibility and resistance to camber deformation. The particular number, size and distribution (i.e., their location within the snowboard 10) of pockets 26 and springs 36 contained between such pockets 26 will be dependent upon the number of inserts required and the degree of flexibility and resistance to camber deformation desired.

The upper or first 12 and lower or second 18 portions of snowboard 10 are preferably formed of a selected thermoplastic material. Suitable such materials are acrylonitrile-butadiene-styrene (ABS), acetates, acrylics, cellulosics, chlorinated polyethers; fluorocarbons, polyamides, polycarbonates, polyethylenes, polypropylenes, polyimides, polyphenylene oxides, polystyrenes, polysulfones, polyurethanes, polyvinyl chlorides, and alloys thereof. One presently preferred thermoplastic material is a polycarbonate. Either or both of the upper or first 12 and lower or second 18 portions may, thus, be formed by conventional injection molding or thermoforming techniques.

As is well-known, the thermoforming process can produce single products in small quantities or multiple-cavity formed parts in large amounts equivalent to output quantities in injection molding, with equipment which has a higher output rates. This technique is very competitive with injection molding for certain size and shape products. Also this technique is competitive with blow molding hollow parts (such as the snowboard 10 according to the present invention) where two halves can be thermoformed, followed by secondary operations of bonding.

Thermoforming of plastic sheet, as used in accordance with certain preferred steps of the present invention, has developed rapidly in recent years. Basically, this process consists of heating thermoplastic sheet to a formable plastic state and then applying air and/or mechanical aids to shape it to the contours of a mold. Air pressure may range from almost zero to several hundreds of pounds per square inch. Up to approximately 14 pounds per square inch (i.e., atmospheric pressure), the pressure is obtained by evacuating the space between the sheet and the mold in order to utilize this atmospheric pressure. This range, known as vacuum forming, will give satisfactory reproduction of the mold configuration in the majority of forming applications.

Accordingly, the particular method of forming the upper or first 12 and lower or second 18 portions of the snowboard 10 according to the present invention will depend not only on the shape of the mold forming such portions 12, 18, but also the quantities of such snowboards 10 to be produced and other desirable aspects such as durability, flexibility and price of the snowboard 10.

Figure 3:
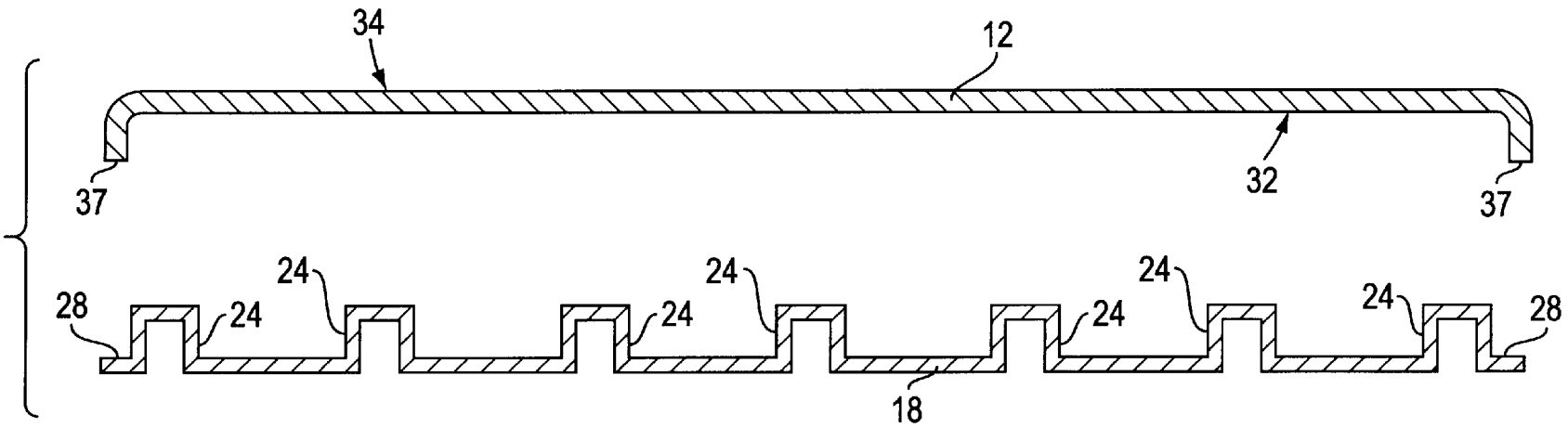
FIG. 3 is an exploded sectional view of the upper and lower portions of the snowboard shown in FIGS. 1 and 2, taken along the lines 3—3.

Referring now to FIG. 3, there is shown in greater detail an exploded sectional view of the upper or first 12 and lower or second 18 portions of the snowboard 10 shown in FIGS. 1 and 2, taken along the lines 3—3. The upper or first portion 12 includes an upper peripheral rim 37. Lower or second portion 18 includes a plurality of flanges comprising the plurality of ribs 24 and a lower peripheral rim 28 formed about the periphery of the lower or second portion 18. Each such flange thereby provides a corresponding bonding site 30 (FIG. 4) for the upper or first 12 and lower or second 18 portions.

Figure 4:
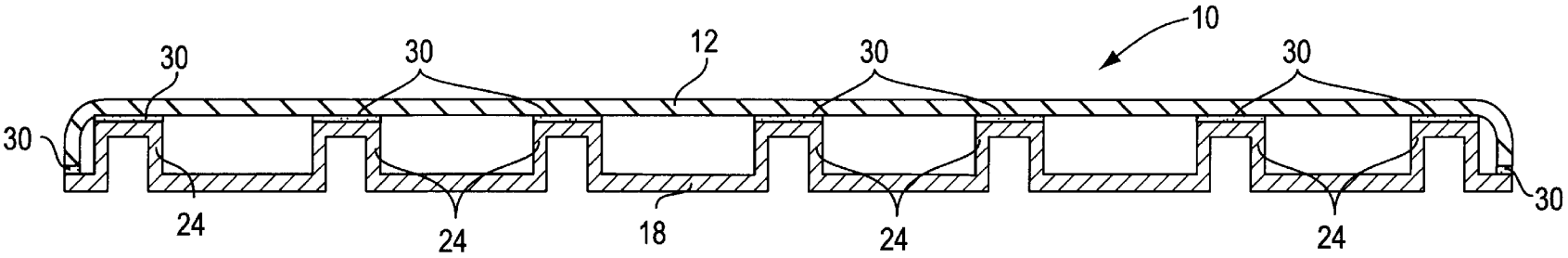
FIG. 4 is a sectional view of the assembled upper and lower portions of the snowboard, formed in accordance with the present invention.

Such bonding sites 30, as are shown more adequately in FIG. 4 (illustrating a sectional view of the assembled upper or first 12 and lower or second 18 portions of snowboard 10, formed in accordance with the present invention). In accordance with one presently preferred embodiment of this invention, the bonding sites 30 are formed by plastic welding each flange to the inner surface 32 of the upper or first portion 12. Any well-known method of plastic welding (e.g., ultrasonic welding) may be used according to the present invention. Alternatively, the bonding sites 30 may be formed by applying a thermosetting resin to each flange and bonding same to the inner surface 32 of the upper or first portion 12.

In thermosetting resins, as is well-known, reactive portions of the molecules form cross-links between the long molecules during polymerization. The linear polymer chains are thus bonded together to form a three-dimensional network. Therefore, once polymerized or hardened, the material cannot be softened by heating without degrading some linkages. Thermosets are usually purchased as liquid monomer-polymer mixtures or as a partially polymerized molding compound. In this uncured condition, they can be formed to the finished shape with or without pressure and polymerized with chemicals or heat. One suitable class of such thermosetting resins which may be used with the snowboard 10 according to the present invention is epoxy resins.

Figure 5:
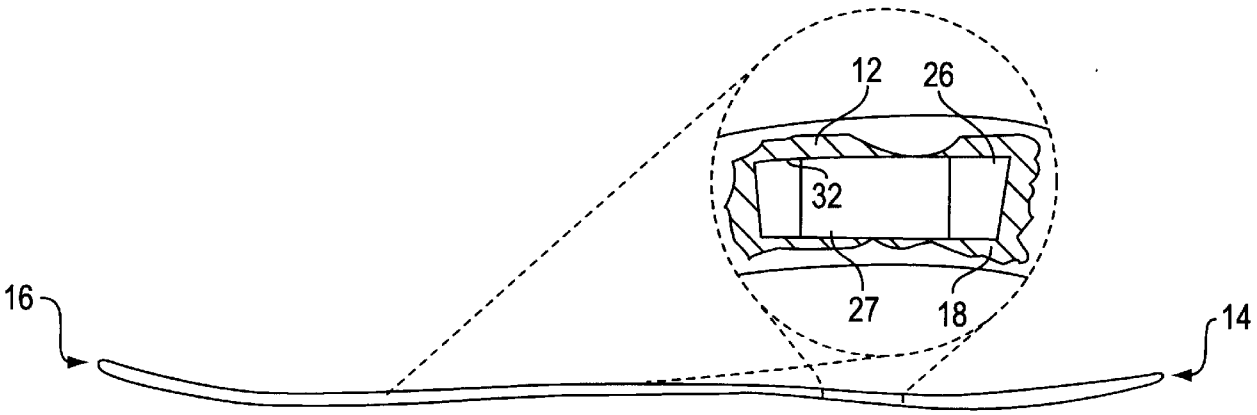
FIG. 5 is a side view of the assembled snowboard according to the present invention.

FIG. 5 is a side view of the assembled snowboard according to the present invention, with a greatly enlarged portion showing one pocket or cavity 26, with its respective binding insert 27, and a leaf spring 36 shown. By insertion of one or more (and, preferably, two) leaf springs 36 between the pockets or cavities 26 formed between the upper of first 12 and lower or second 18 portions of the assembled snowboard 10. Such leaf springs 36, thus, provide a means for maintaining the camber of the snowboard 10 shown in FIG. 5. In accordance with a still further important aspect of the present invention, other forms of springs may be used and the particular material (e.g., metal, plastic, etc.) from which such springs are made will be dependent upon the desired characteristics of flexibility and camber deformation resistance.

Obviously, many modifications and variations of the improved recreational board according to the present invention are possible when viewed in light of the foregoing teachings. For example, further stiffness adjustments can be made by including a layer of fiberglass cloth/thermosetting resin between the assembled upper or first 12 and lower or second 18 portions and a conventional high-density polyethylene liner base (not shown) which is installed to cover the grooves 24 formed in the lower or second portion 18 and, thereby, provide lubricity. Preferably, the thermosetting resin would be an epoxy resin, but any other resin demonstrating good adhesion to the selected thermoplastic (e.g., polycarbonate) and good stiffness when cured would be equally acceptable. Moreover, the snowboard 10 according to the present invention could be finished in the usual manner to include stainless steel edge strips, binding inserts, and decorative graphics. It could, likewise, be used in other recreational board applications including, but not limited to, surfboards, wake boards, sand boards, and skateboards. It should be understood, therefore, that all such modifications and variations would be deemed to fall within the scope of the appended claims.

What we claim as our invention is:

1. A snowboard comprising:

a thermoplastic upper portion having an outer surface and an inner surface, wherein said upper portion includes a peripheral rim which is formed between said outer and inner surfaces;

a thermoplastic lower portion including a plurality of flanges, said plurality of flanges further comprising a peripheral collar and a plurality of ribs; and means for bonding said plurality of flanges to said inner surface of said upper portion, thereby providing the assembled snowboard, and further whereby said bonding means bonds said peripheral rim to said peripheral collar and said plurality of ribs to said inner surface of said upper portion.

2. The snowboard according to claim 1, wherein said peripheral rim and said peripheral flange define a substantially similar peripheral shape.

3. The snowboard according to claim 1, wherein said bonding means comprises plastic welding.

4. The snowboard according to claim 1, wherein said bonding means comprises a thermosetting resin.

5. The snowboard according to claim 4, wherein said thermosetting resin comprises an epoxy resin.

* * * * *